US005309659A

United States Patent [19]

Eastman

[11] Patent Number: 5,309,659

[45] Date of Patent: May 10, 1994

[54] FRAME

[76] Inventor: Richard H. Eastman, 36 Mallard Rd., Needham, Mass. 02192

[21] Appl. No.: 974,934

[22] Filed: Nov. 12, 1992

[51] Int. Cl.[5] ..... G09F 7/04

[52] U.S. Cl. ..... 40/600; 40/661; 248/206.5

[58] Field of Search ..... 40/600, 661, 621, 159, 40/642; 248/206.5; 206/818

[56] References Cited

U.S. PATENT DOCUMENTS

| | | | |
|---|---|---|---|
| 2,825,447 | 3/1958 | Kurland | 206/818 X |
| 3,007,568 | 11/1961 | Kurland | 206/818 X |
| 3,744,542 | 7/1973 | Stephens et al. | 206/818 X |
| 4,196,535 | 4/1980 | Heimo | 40/661 X |
| 4,746,045 | 5/1988 | Schweim | 40/661 X |

FOREIGN PATENT DOCUMENTS

| | | | |
|---|---|---|---|
| 1059689 | 2/1967 | United Kingdom | 40/661 |
| 2225893 | 6/1990 | United Kingdom | 40/661 |

*Primary Examiner*—Brian K. Green
*Attorney, Agent, or Firm*—William Nitkin

[57] ABSTRACT

A picture frame having a substantially stiff, rectangular, planar transparent sheet with lip members disposed on two rear opposing sides to slideably receive therein the object to be displayed directly behind the transparent sheet and a sheet of magnetic material to be received within said lips directly behind the object to be displayed. The magnetic sheet, when placed against a metallic surface, holds the frame in place by its attraction to such metallic surface.

1 Claim, 2 Drawing Sheets

FRAME

BACKGROUND OF THE INVENTION

1. Field of the Invention

The device of this invention resides in the area of frames utilizing magnetic members to retain them in place on a metallic surface.

2. Description of the Prior Art

Picture frames having small segments of magnets on the back thereof in small segments have been utilized to retain such frames in position on a metallic object.

SUMMARY OF THE INVENTION

It is an object of this invention to provide a new type of frame utilizing magnetic sheet material to adhere the frame to a metallic object. The frame consists of a generally planar transparent holder made of rectangular stiff plastic sheet material with upper and lower lip retention members which can be portions of two opposing sides of the holder's sheet material folded back against itself extending inwards for a specific distance, forming slots between the lip retention members and the rear of the holder on the upper and lower rear portions of the holder into which are slid a photograph or other thin planar object to be displayed and a rectangular piece of magnetic sheet material which fits behind the object to be displayed. This sandwich structure, with the holder being clear so that the photograph or object can be seen therethrough is then placed on a metallic surface with the frame being held in place by the magnetic sheet material.

DESCRIPTION OF THE PREFERRED EMBODIMENT(S)

Figures 1, 2:
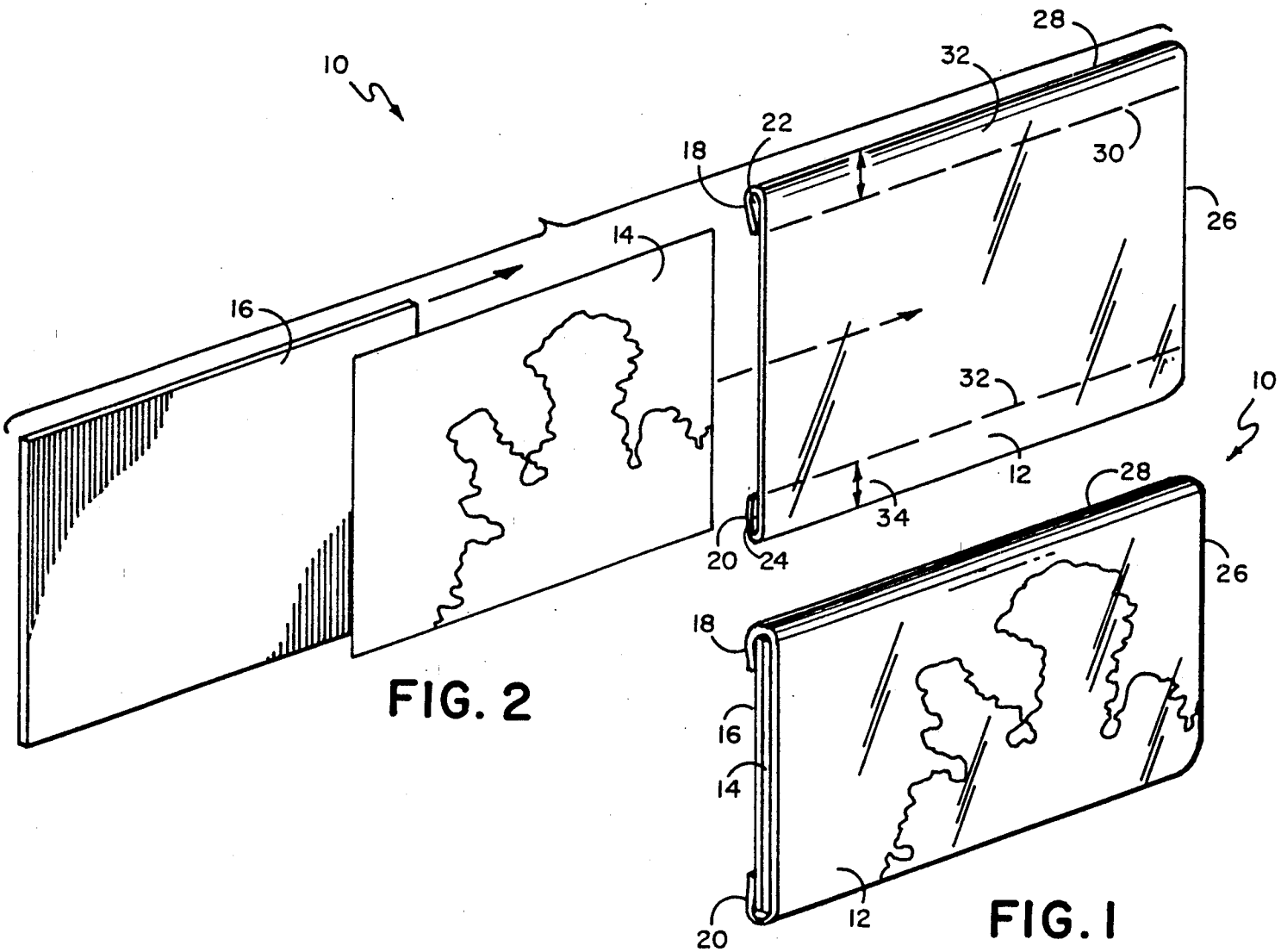
FIG. 1 illustrates the frame of this invention showing the holder with the magnetic sheet material and photograph retained therein.
FIG. 2 illustrates the holder with the magnetic sheet material and photograph about to be slid therein.

FIG. 1 illustrates frame 10 of this invention showing holder 12 with photograph 14 slideably inserted therein which can be a photograph as shown or other thin, planar object to be displayed. The use of the term photograph herein is meant to include other types of planar objects such as a newspaper article, drawing, etc. which one wishes to display. Magnetic sheet material 16 is seen positioned behind photograph 14 and is retained in place by upper and lower lip retention members 18 and 20 which are disposed on opposite side edges of holder 12 which lip retention members bend around to the rear of holder 12 and are shown horizontally disposed, forming upper and lower slots 22 and 24 into which are slid photograph 14 and magnetic sheet material 16.

Figure 3:
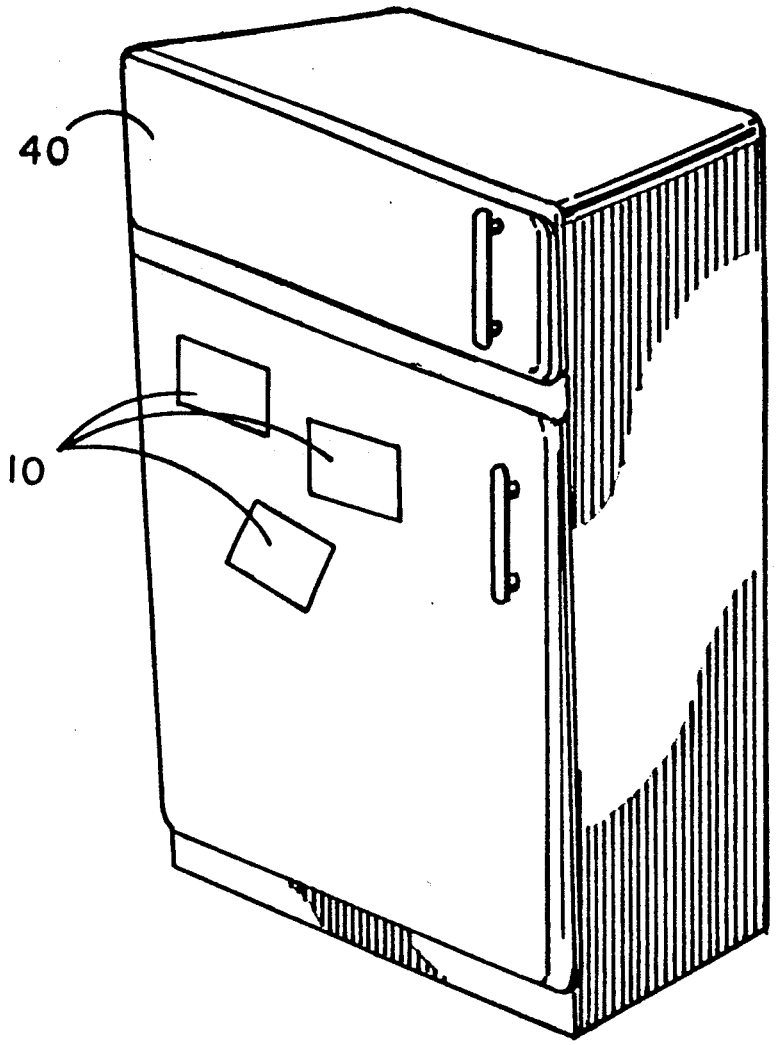
FIG. 3 illustrates frames of this invention mounted on a metallic surface such as a refrigerator.

In FIG. 2 holder 12 is seen which can be made of substantially stiff but somewhat flexible transparent plastic sheet material and the like. Upper lip retention member 18 and lower lip retention member 20 are formed by having the upper and lower side portions of holder 12 folded around against the rear of holder 12 so that each fold forms a lip extending a specific distance indicated by numeral 32 on the upper portion and numeral 34 on the lower portion, inward from the edges of holder 12. Holder 12 has a specific length 28 and specific height 26. Upper and lower lip retention members 18 and 20 extend inward and are resiliently openable to gain access to upper and lower slots 22 and 24 formed between upper and lower lip retention members 18 and 20 and the rear of holder 12. Upper and lower lip retention members 18 and 20 exert pressure on whatever thin, planar object is slid into slots 22 and 24 by the nature of the plastic sheet material's resiliency. Photograph 14, which as mentioned above can also include any thin, planar object, in a preferred embodiment has approximately the same dimensions of length 28 and width 26 as holder 12 to fit, and be retained, within slots 22 and 24. Magnetic sheet material 16 is well known in the art and in a preferred embodiment has approximately the same length and width measurements as that of holder 12 to fit within slots 22 and 24 such that magnet sheet material 16 extends above lip edge 30 and below lip edge 32 so that when inserted in sandwich form with photograph 14 in front of it within slots 22 and 24, such as seen in FIG. 1, photograph 14 is maintained in place by the pressure of upper and lower lip retention members 18 and 20 pressing on the rear of magnetic sheet material 16 which in turn presses against and against photograph 14. Magnetic sheet material 16 can be the same size as photograph 14. The entire structure can then be placed against a metallic object such as refrigerator 40, as seen in FIG. 3, with magnetic sheet material 16 retaining it in position thereagainst while displaying the photograph. The flexibility of holder 12 allows sufficient rearward bending that lips 18 and 20 do not prevent magnetic sheet material 16 from maintaining contact with the metallic surface. Holder 12 can be made of cellulose acetate of thickness of approximately 15 mils or equivalent material. Magnetic sheet material 16 can also be approximately 15 mils thick.

The frame of this invention, being economical to produce, avoids the expensive construction of prior art frames where magnetic members are disposed in segments behind rectangular plastic frames disposed around the object to be displayed. In the frame of this invention the entire sheet of magnetic material forms both the backing for the frame as well as the frame's retention means against a metallic surface. Upper and lower retention members 18 and 20 should be sufficiently strong in their compression against the rear of holder 12 to prevent the sliding out of the photograph and the magnetic sheet material should the frame be placed in a vertical position with slots 22 and 24 opening downward. In a preferred embodiment no matter in what direction the frame is placed, photograph 14 will be displayed and retained within the frame by the pressure of upper and lower lip retention members 18 and 20 urging towards the front of holder 12, retaining the magnetic sheet material and photograph therein.

Although the present invention has been described with reference to particular embodiments, it will be apparent to those skilled in the art that variations and modifications can be substituted therefor without departing from the principles and spirit of the invention.

I claim:

1. A frame member having a front for displaying a planar object on a metallic surface, comprising:

a transparent holder of stiff, resilient plastic having a top, a bottom, a front, a rear, a length and a width;

an upper lip retention member formed from the top of said holder being folded rearwards, around and behind said holder, said upper lip retention member having a width;

a lower lip retention member formed from the bottom of said holder being folded rearwards, around and behind said holder, said lower lip retention member having a width, said upper and lower lip retention members pressing against the rear of said holder towards the front of said holder;

an upper slot defined between said upper lip retention member and the rear of said holder;

a lower slot defined between said lower lip retention member and the rear of said holder; and a sheet of magnetic material having a front and a rear and having approximately the same length and width as the length and width of said holder, said sheet of magnetic material slideably disposed within said upper slot and said lower slot for sandwiching said planar object between the rear of said transparent holder and the front of said sheet of magnetic material, said transparent holder from retaining said planar object when inserted within said frame member; said sheet of magnetic material being magnetically attracted to said metallic surface for retaining said frame member in a fixed position on said metallic surface when placed thereagainst.

* * * * *